US006623247B2

(12) United States Patent
Du

(10) Patent No.: US 6,623,247 B2
(45) Date of Patent: Sep. 23, 2003

(54) METHOD AND APPARATUS FOR CONTROLLING A VARIABLE DISPLACEMENT HYDRAULIC PUMP

(75) Inventor: Hongliu Du, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 29 days.

(21) Appl. No.: 09/858,738

(22) Filed: May 16, 2001

(65) Prior Publication Data

US 2002/0176784 A1 Nov. 28, 2002

(51) Int. Cl.[7] ..... F04B 49/00

(52) U.S. Cl. ..... 417/53; 417/213; 417/44.2; 417/222.1; 91/505

(58) Field of Search ..... 417/53, 222.1, 417/213, 212, 218, 44.2, 44.11; 91/504, 505, 506

(56) References Cited

U.S. PATENT DOCUMENTS 3,744,243 A * 7/1973 Faisandier ..... 60/431
3,788,775 A * 1/1974 Leutner et al. ..... 417/222
4,139,987 A * 2/1979 Budzich ..... 60/445
4,510,750 A * 4/1985 Izumi et al. ..... 60/443
4,655,689 A * 4/1987 Westveer et al. ..... 417/53
5,183,393 A * 2/1993 Schaffner ..... 417/218
5,697,764 A 12/1997 Oda et al.
5,865,602 A 2/1999 Nozari
6,095,760 A * 8/2000 Houtman ..... 417/222.2
6,375,433 B1 * 4/2002 Du et al. ..... 417/53

FOREIGN PATENT DOCUMENTS

GB 2 291 986 A * 2/1996
GB 2 291986 * 2/1996
KR 0 610940 A1 * 2/1994

* cited by examiner

*Primary Examiner*—Charles G. Freay
*Assistant Examiner*—Han L Liu
(74) *Attorney, Agent, or Firm*—Steven D Lundquist; Robin S. Fahlberg

(57) ABSTRACT

A method and apparatus for controlling a variable displacement hydraulic pump having a swashplate pivotally attached to the pump. The method and apparatus includes determining a desired swashplate angle as a function of a power limit of the pump, determining an actual swashplate angle, determining a value of discharge pressure of the pump, moving a servo valve spool to a desired position as a function of the desired swashplate angle, the actual swashplate angle and the discharge pressure, and responsively moving the swashplate to the desired swashplate angle position.

28 Claims, 5 Drawing Sheets

METHOD AND APPARATUS FOR CONTROLLING A VARIABLE DISPLACEMENT HYDRAULIC PUMP

TECHNICAL FIELD

This invention relates generally to a method and apparatus for controlling an angle of a swashplate pivotally attached to a variable displacement hydraulic pump and, more particularly, to a method and apparatus for controlling an angle of a swashplate as a function of a power limit of the pump.

BACKGROUND

Variable displacement hydraulic pumps, such as axial piston variable displacement pumps, are widely used in hydraulic systems to provide pressurized hydraulic fluid for various applications. For example, hydraulic earthworking and construction machines, e.g., excavators, bulldozers, loaders, and the like, rely heavily on hydraulic systems to operate, and hence often use variable displacement hydraulic pumps to provide the needed pressurized fluid.

These pumps are driven by a constant speed mechanical shaft, for example by an engine, and the discharge flow rate, and hence pressure, is regulated by controlling the angle of a swashplate pivotally mounted to the pump.

Operation of the pumps, however, is subject to variations in pressure and flow output caused by variations in load requirements. It has long been desired to maintain the pressure output of the pumps in a consistent manner so that operation of the hydraulic systems is well behaved and predictable. Therefore, attempts have been made to monitor the pressure output of a pump, and control pump operation accordingly to compensate for changes in loading.

A problem incurred when a pump is operated under varying loads is that the power available to the pump, i.e., from the engine, is limited. Therefore, although certain hydraulic pressure and hydraulic flow rate demands may be made of a pump in operation, it may not be feasible to supply the power required for the desired pressure and flow rate combination. It is desired, therefore, to control the operation of the pump in a manner that is consistent with overall power demands placed on the total hydraulic machine.

The present invention is directed to overcoming one or more of the problems as set forth above.

SUMMARY OF THE INVENTION

In one aspect of the present invention a method for controlling a variable displacement hydraulic pump having a swashplate pivotally attached to the pump is disclosed. The method includes the steps of determining a desired swashplate angle as a function of a power limit of the pump, determining an actual swashplate angle, determining a value of discharge pressure of the pump, moving a servo valve spool to a desired position as a function of the desired swashplate angle, the actual swashplate angle and the discharge pressure, and responsively moving the swashplate to the desired swashplate angle position.

In another aspect of the present invention an apparatus for controlling a variable displacement hydraulic pump is disclosed. The apparatus includes a swashplate pivotally attached to the pump, a control servo operable to control an angle of the swashplate relative to the pump, a servo valve having an output port connected to the control servo and an input port connected to a pump output port, means for determining an actual swashplate angle, means for determining a value of discharge pressure of the pump, and a controller connected to the servo valve and adapted to determine a desired swashplate angle as a function of a power limit of the pump, and to move a servo valve spool in the servo valve to a desired position as a function of the desired swashplate angle, the actual swashplate angle, and the discharge pressure.

DETAILED DESCRIPTION

Figure 1:
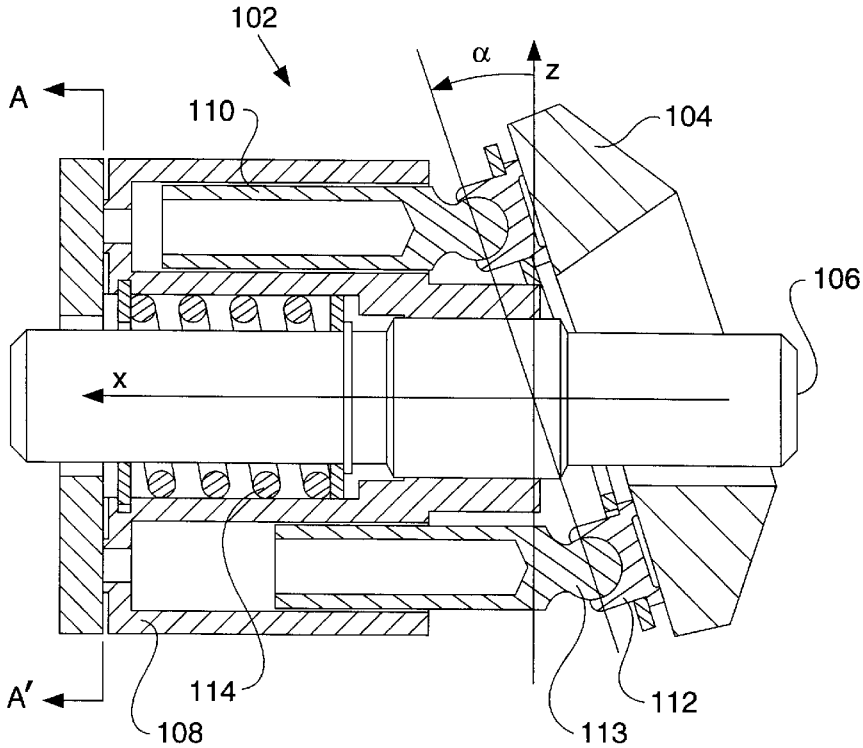
FIG. 1 is a diagrammatic side profile cutaway view of a variable displacement hydraulic pump suitable for use with the present invention.

Referring to the drawings, a method and apparatus 100 for controlling a variable displacement hydraulic pump 102 is disclosed.

Figure 2:
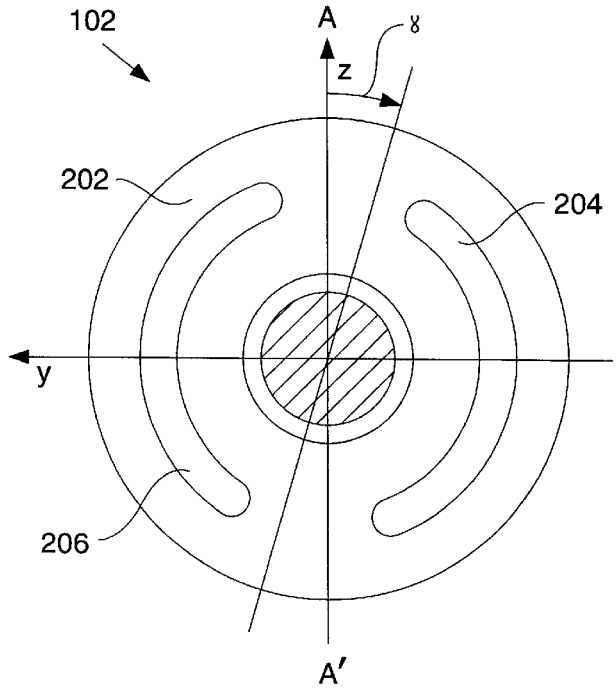
FIG. 2 is a diagrammatic end view of the pump of FIG. 1.

With particular reference to FIGS. 1 and 2, the variable displacement hydraulic pump 102, hereinafter referred to as pump 102, is preferably an axial piston swashplate hydraulic pump 102 having a plurality of pistons 110, e.g., nine, located in a circular array within a cylinder block 108. Preferably, the pistons 110 are spaced at equal intervals about a shaft 106, located at a longitudinal center axis of the block 108. The cylinder block 108 is compressed tightly against a valve plate 202 by means of a cylinder block spring 114. The valve plate includes an intake port 204 and a discharge port 206.

Each piston 110 is connected to a slipper 112, preferably by means of a ball and socket joint 113. Each slipper 112 is maintained in contact with a swashplate 104. The swashplate 104 is inclinably mounted to the pump 102, the angle of inclination $\alpha$ being controllably adjustable.

Figure 3:
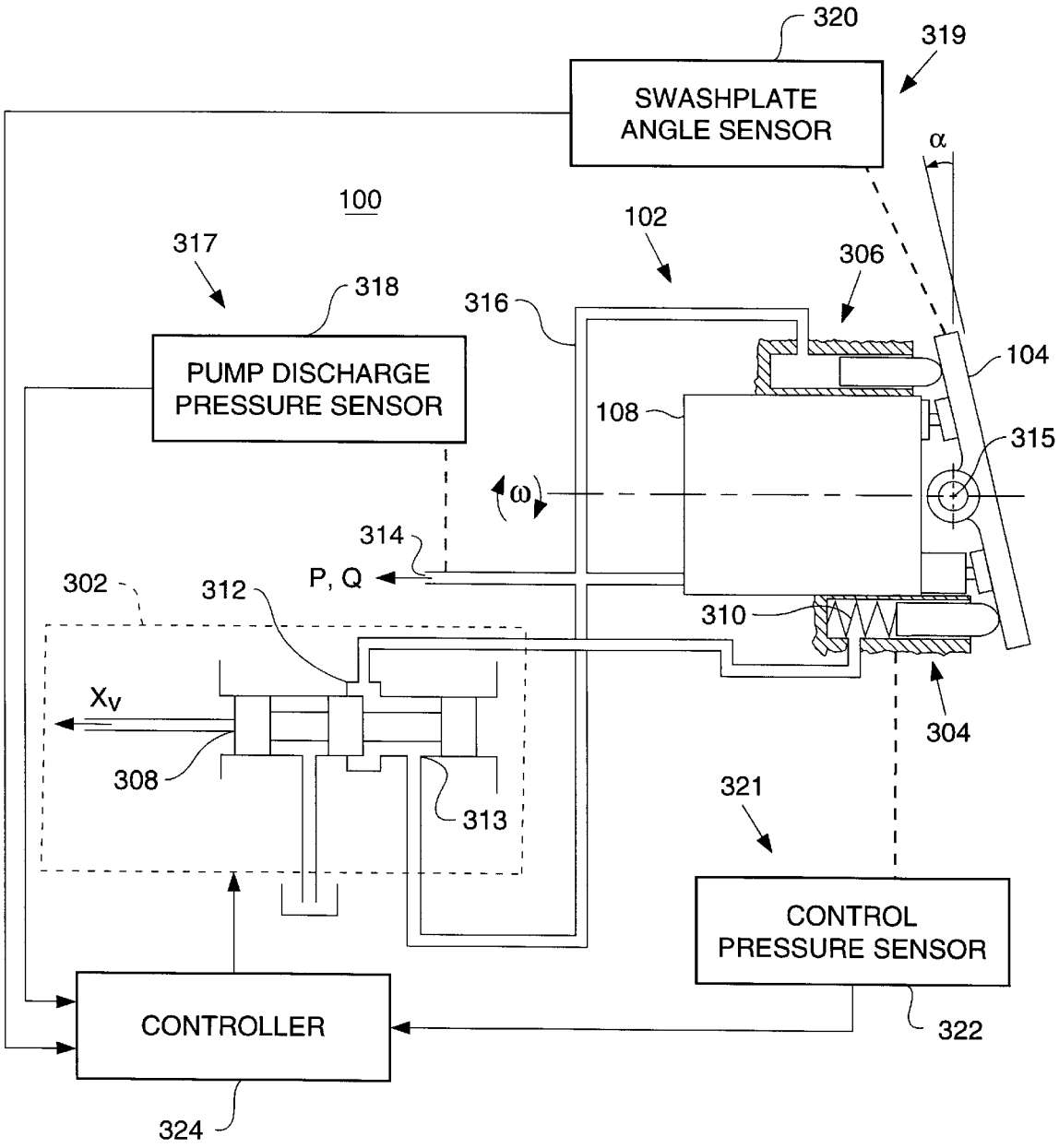
FIG. 3 is a diagrammatic illustration of a pump including a servo valve.

With continued reference to FIGS. 1 and 2, and with reference to FIG. 3, operation of the pump 102 is illustrated. The cylinder block 108 rotates at a constant angular velocity $\omega$. As a result, each piston 110 periodically passes over each of the intake and discharge ports 204,206 of the valve plate 202. The angle of inclination $\alpha$ of the swashplate 104 causes the pistons 110 to undergo an oscillatory displacement in and out of the cylinder block 108, thus drawing hydraulic fluid into the intake port 204, which is a low pressure port, and out of the discharge port 206, which is a high pressure port.

In the preferred embodiment, the angle of inclination $\alpha$ of the swashplate 104 inclines about a swashplate pivot point 315 and is controlled by a servo valve 302. A servo valve spool 308 is controllably moved in position within the servo valve 302 to control hydraulic fluid flow at an output port 314 of the servo valve 302. In the preferred embodiment, the servo valve 302 is an electro-hydraulic valve, and is thus controlled by an electrical signal being delivered to the valve 302.

A control servo 304, in cooperation with a servo spring 310, receives pressurized fluid from the output port 312 of the servo valve 302, and responsively operates to increase the angle of inclination $\alpha$ of the swashplate 104, thus increasing the stroke of the pump 102. The pump 102 provides pressurized hydraulic fluid to the discharge port 206 of the valve plate 202 by means of a pump output port 314. A biasing servo 306 receives pressurized fluid from the output port 314 of the pump 102 via a divertor line 316, and responsively operates to decrease the angle of inclination $\alpha$ of the swashplate 104, thus decreasing the stroke of the pump 102. Preferably, the control servo 304 is larger in size and capacity than the biasing servo 306.

A means 317 for determining a value of discharge pressure, preferably located at the pump output port 314, is adapted to determine the output pressure of the hydraulic fluid from the pump 102. In the preferred embodiment, the means 317 for determining a value of discharge pressure includes a pump discharge pressure sensor 318, adapted to sense the output pressure of the hydraulic fluid from the pump 102.

Alternatively, the pump output pressure sensor 318 may be located at any position suitable for sensing the pressure of the fluid from the pump 102, such as at the discharge port 206 of the valve plate 202, at a point along the hydraulic fluid line from the pump 102 to the hydraulic system being supplied with pressurized fluid, and the like. In the preferred embodiment, the pump discharge pressure sensor 318 is of a type well known in the art and suited for sensing pressure of hydraulic fluid.

A means 319 for determining an actual swashplate angle is adapted to determine the angle $\alpha$ of the swashplate 104. In the preferred embodiment, the means 319 for determining an actual swashplate angle includes a swashplate angle sensor 320, for example, a resolver, strain gauge, or other suitable sensor.

In one embodiment of the present invention, the means 317 for determining a value of discharge pressure and the means 319 for determining an actual swashplate angle are sufficient for purposes of the invention. In a second embodiment, a means 321 for determining a value of control pressure is used also for purposes of the invention. Preferably, the means 321 for determining a value of control pressure is adapted for determining the hydraulic pressure applied to the control servo 304, and may be located at any suitable location from the servo valve output port 312 to the control servo 304. In addition, the means 321 for determining a value of control pressure preferably includes a control pressure sensor 322 suited for sensing pressure of hydraulic fluid.

Both above-mentioned embodiments are described in more detail below.

A controller 324 is electrically connected to the servo valve 302, and is adapted to receive information from the means 317 for determining a value of discharge pressure, the means 319 for determining an actual swashplate angle, and the means 321 for determining a value of control pressure, and to process the information for purposes of the present invention, as described in more detail below. The controller 324 is also adapted to deliver control signals to the servo valve 302, for purposes of the present invention.

Figure 4:
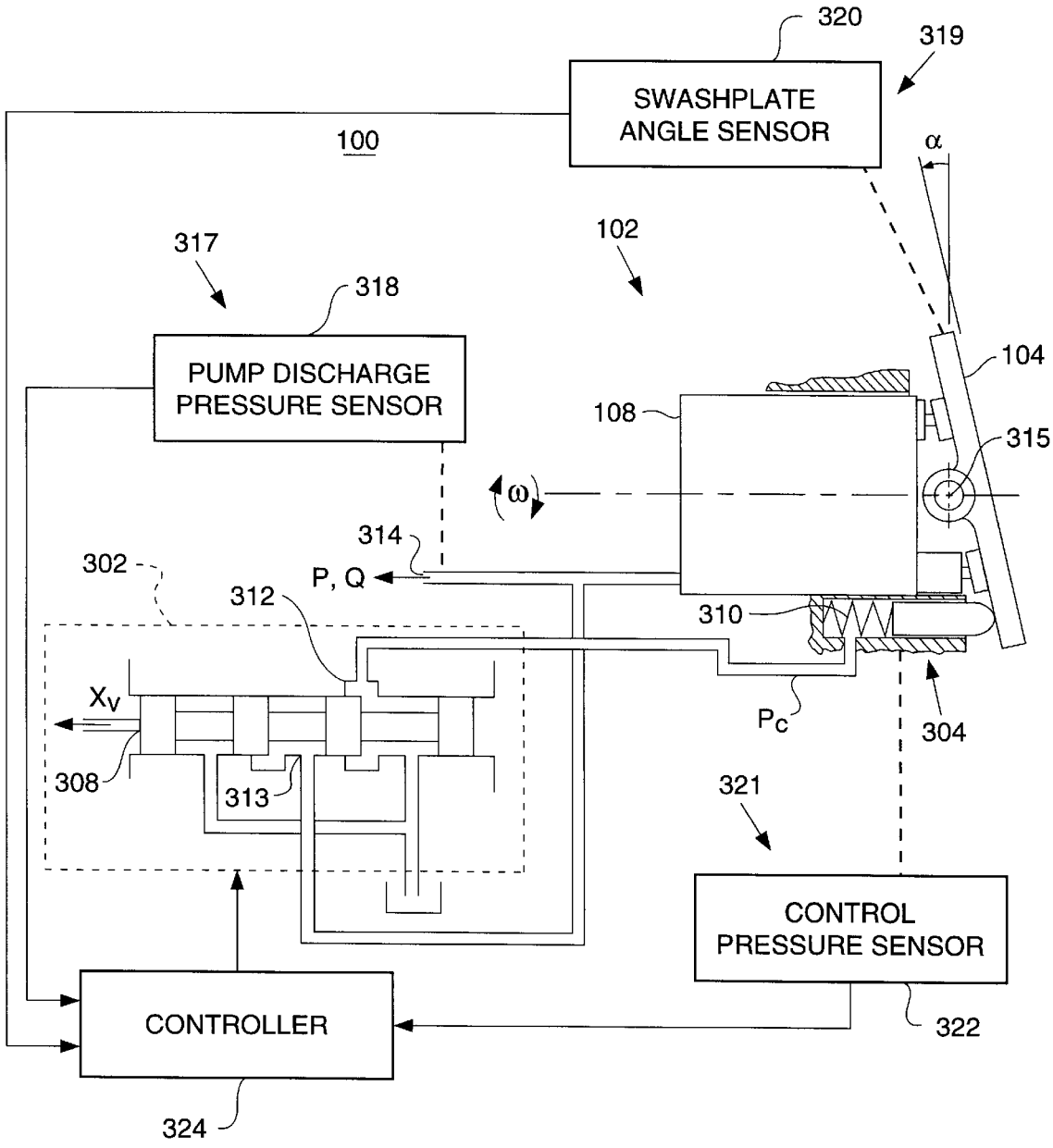
FIG. 4 is a diagrammatic illustration of an alternate configuration of a pump including a servo valve.

FIG. 4 illustrates an alternate configuration of a pump 102 and servo valve 302 in combination. Specifically, the configuration of FIG. 4 is similar to the configuration in FIG. 3, except that the biasing servo 306 and the divertor line 316 are not included. However, operation of the arrangement in FIG. 4, with respect to the present invention, is identical to operation of the arrangement in FIG. 3. The reference to an alternate structural arrangement exemplifies that the present invention may be used effectively with a variety of variable displacement hydraulic pump configurations.

Figure 5:
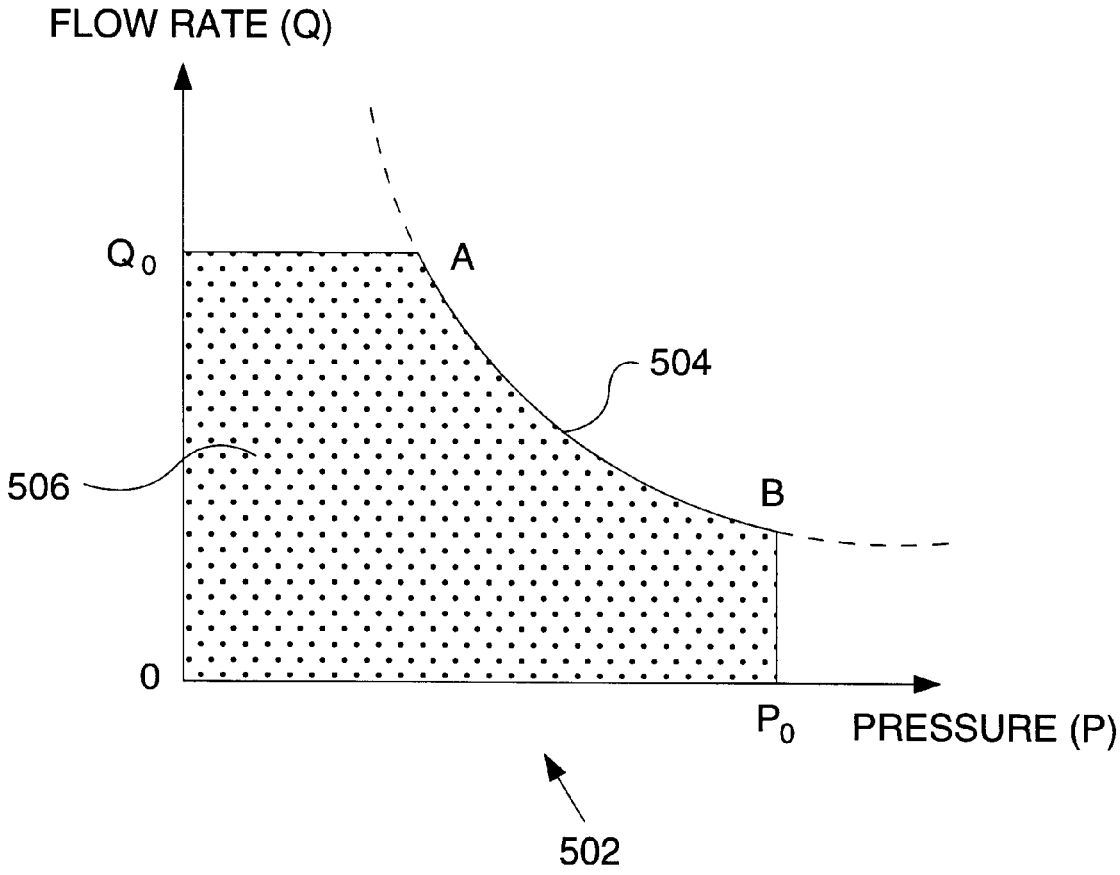
FIG. 5 is a graph illustrating a pump operating envelope having a constant power curve.

Referring to FIG. 5, a graph 502 illustrating an operating envelope of a typical variable displacement hydraulic pump 102 is shown. The horizontal axis of the graph 502 represents discharge pressure P of the pump 102, and the vertical axis represents a flow rate Q of hydraulic fluid through the pump. $P_o$ is the maximum discharge pressure, and $Q_o$ is the maximum flow rate. A curve 504 represents a plot of constant power, i.e., P*Q is a constant. The graph 502 of the operating envelope of a pump 102 is a function of individual pumps 102, and varies with different pumps and with different applications of the pump 102.

For purposes of the present invention, it is noted that it is desired to operate the pump 102 such that operations are either on the constant power curve 504 for optimal efficiency, or in an area 506 under the curve. However, it is not desired to operate the pump 102 under the curve 504 at the values $P_o$ or $Q_o$ since the discharge pressure P or flow rate Q would be operating at a respective maximum value.

Figure 6:
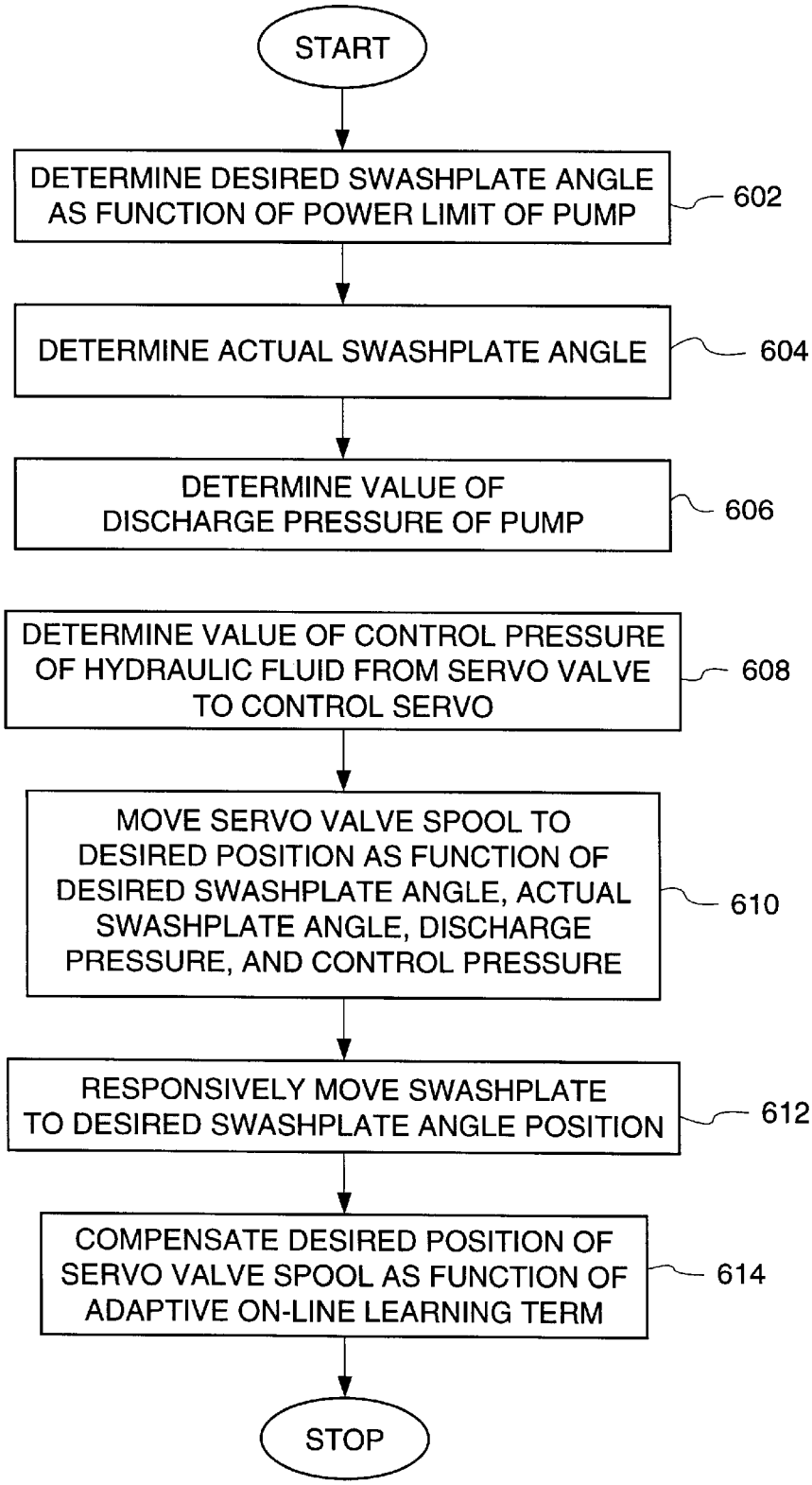
FIG. 6 is a flow diagram illustrating a preferred method of the present invention.

Referring to FIG. 6, a flow diagram illustrating a preferred method of the present invention is shown.

In a first control block 602, a desired swashplate angle $\alpha_d$ is determined as a function of a power limit of the pump. In the preferred embodiment, the desired swashplate angle $\alpha_d$ is determined as a function of the constant power curve 504 shown in FIG. 5 and is determined by the controller 324 using the expression:

$$\alpha_d = \begin{cases} \alpha_d & \text{if } P\alpha < kW_l \\ \dfrac{kW_l}{P} & \text{if } P\alpha \geq kW_l \end{cases} \qquad \text{(Eq. 1)}$$

where P is the discharge pressure of the pump 102, $W_l$ is the power limit on the pump 102, and k is a constant related to geometric parameters of the pump 102.

Eq. 1 is interpreted as follows. If $P\alpha < kW_l$, the operation of the pump 102 is determined to be within the operating envelope, i.e., in the area 506 under the constant power curve, and no constraints on the operation of the pump 102 are needed. However, if $P\alpha \geqq kW_l$, then the operation of the pump 102 is determined to be outside the operating envelope, i.e., outside of the area 506 under the constant power curve, and the operation of the pump 102 must be reduced by reducing the desired swashplate angle to a value of $kW_l/P$.

In a second control block 604, an actual swashplate angle $\alpha$ is determined, preferably by the means 319 for determining an actual swashplate angle, e.g., a swashplate angle sensor 320, as described above.

In a third control block 606, a value of discharge pressure P of the pump 102 is determined, preferably by the means 317 for determining a value of discharge pressure, e.g., a pump discharge pressure sensor 318, as described above.

In a fourth control block 608, a value of control pressure $P_c$ of hydraulic fluid from the servo valve 302 to the control servo 304 is determined, preferably by means 321 for determining a value of control pressure, e.g., a control pressure sensor 322, as described above.

It is noted that in a first embodiment the actual swashplate angle $\alpha$, the discharge pressure P, and the control pressure $P_c$ are all used in furtherance of the present invention, and in a second embodiment only the actual swashplate angle $\alpha$ and the discharge pressure P are used. The value of control pressure $P_c$ is not used in the second embodiment as a result of some simplifying assumptions which exchange speed and simplicity for accuracy in the results. The two embodiments are described in detail below.

In a fifth control block 610, the servo valve spool 308 is moved to a desired position as a function of the desired swashplate angle $\alpha_d$, the actual swashplate angle $\alpha$, the discharge pressure P, and, in the first embodiment, the control pressure $P_c$. Preferably, the controller 324 receives the information regarding the desired swashplate angle $\alpha_d$, the actual swashplate angle $\alpha$, the discharge pressure P, and, in the first embodiment, the control pressure $P_c$, and responsively delivers a signal to the servo valve 302, which in turn moves the servo valve spool 308 to the desired position.

Preferably, in the first embodiment, the desired position of the servo valve spool 308 is determined by:

$$x_v = \frac{\frac{V_c(\alpha)}{\beta}\dot{P}_c + C_l P_c - A_c L_c \dot{\alpha}_d - k_p \Delta\alpha}{C_d w \sqrt{\frac{2}{\rho}\left(\frac{P + sgn(x_v)P}{2} - sgn(x_v)P_c\right)}} \quad \text{(Eq. 2)}$$

where $x_v$ is the servo valve spool position, $V_c$ is a volume of a chamber in the control servo 304, $\beta$ is a fluid bulk modulus, $\dot{P}_c$ is a rate of change of control pressure $P_c$, $C_l$ is a leakage coefficient of the pump 102 and control servo 304, $A_c$ is a sectional area of the control servo 304, $L_c$ is a distance from the control servo 304 to the swashplate pivot point 315, $k_d$ is a control gain, $\Delta\alpha=\alpha_d-\alpha$, $C_d$ is a valve orifice coefficient, w is a running speed of the pump 102, and $\rho$ is a fluid mass density.

By using some simplifying assumptions, not shown, the control pressure may be expressed as:

$$P_c = \frac{rnA_p\gamma}{2\pi A_c L_c} P \quad \text{(Eq. 3)}$$

where r is the radius of the piston pitch circle, n is the number of pistons, $A_p$ is the sectional area of a piston, and $\gamma$ is the pressure carry-over angle.

Substituting Eq. 3 into Eq. 2, and making further simplifying assumptions, not shown, the second embodiment for determining the desired servo valve spool position is:

$$x_v \approx \frac{-A_c L_c \dot{\alpha}_d - k_p \Delta\alpha}{C_d w \sqrt{\frac{1}{\rho}\left(1 + sgn(x_v)\left(1 - \frac{rnA_p\gamma}{\pi A_c L_c}\right)\right)}\sqrt{P}} \quad \text{(Eq. 4)}$$

where the position of the servo valve spool 308 is determined as an approximation.

It is noted that, with gain scheduling, the second embodiment shown in Eq. 4 can be reduced still further to:

$$x_v \approx -f(P)\dot{\alpha}_d - k_p(P)\Delta\alpha \quad \text{(Eq. 5)}$$

which is essentially a gain scheduling PD control where f(P) and $k_p$(P) are discrete nonlinear mappings between the pump discharge pressure P, which can be implemented by look-up tables.

In a sixth control block 612, the swashplate 104 is responsively moved to the desired swashplate angle position $\alpha_d$ by way of the servo valve spool position and the control servo 304.

In a seventh control block 614, the desired position of the servo valve spool 308 is compensated as a function of an adaptive on-line learning term. For example, in the embodiment exemplified by Eq. 4, certain uncertainties contribute to a degree of error in the determination of the desired position of the servo valve spool 308. The pressure carry-over angle $\gamma$ is not known with any degree of certainty. In addition, certain physical dimensions of the pump 102, e.g., $A_c$, $L_c$, and $A_p$, vary due to manufacturing and assembly tolerances. Furthermore, other parameters, such as hydraulic fluid viscosity, temperature, and pressure nonlinearities contribute to uncertainties in the determination of the desired position of the servo valve spool 308.

Therefore, Eq. 4 can be modified by the inclusion of an adaptive on-line learning term to compensate for the uncertainties.

$$x_v \approx \frac{-A_c L_c \dot{\alpha}_d - k_p \Delta\alpha}{C_d w \sqrt{\frac{1}{\rho}\left(1 + sgn(x_v)\left(1 - \frac{rnA_p\gamma}{\pi A_c L_c}\right)\right)}\sqrt{P}} + k_a \frac{\dot{\alpha}_d}{\sqrt{P}} \quad \text{(Eq. 6)}$$

where $$k_a \frac{\dot{\alpha}_d}{\sqrt{P}}$$

is the adaptive on-line learning term, and the adaptation law of $k_a$ is $$\dot{k}_a = -\eta\Delta\alpha \frac{\dot{\alpha}_d}{\sqrt{P}} \quad \text{(Eq. 7)}$$

where $\dot{k}_a$ is the rate of change of the constant $k_a$, and $\eta$ is a constant which determines the rate of adaptation, i.e., the learning rate. For example, a small value of $\eta$ will result in a slow learning rate that gradually and smoothly adapts to a more accurate value, and a high value of $\eta$ will result in a fast learning rate that tends to overshoot the final accurate value before reaching the desired term.

Industrial Applicability

The present invention is suited for a variety of physical configurations of variable displacement hydraulic pumps in that control may be implemented by software and a controller for virtually any system which incorporates an electro-hydraulic servo valve. Therefore, the present invention may be implemented as a stand-alone device within the pump unit, or may be incorporated into an upper level system controller.

Other aspects, objects, and features of the present invention can be obtained from a study of the drawings, the disclosure, and the appended claims.

What is claimed is:

1. A method for controlling a variable displacement hydraulic pump having a swashplate pivotally attached to the pump, including the steps of:

determining at least one previous desired swashplate angle;

determining a desired swashplate angle as a function of a power limit of the pump;

determining an actual swashplate angle;

determining a value of discharge pressure of the pump;

moving a servo valve spool in a servo valve to a desired position as a function of the at least one previous desired swashplate angle, the desired swashplate angle, the actual swashplate angle, and the discharge pressure; and responsively moving the swashplate to the desired swashplate angle position.

2. A method, as set forth in claim 1, wherein determining a desired swashplate angle as a function of a power limit of the pump includes the step of determining a desired swashplate angle which responsively maintains operation of the pump at a value not to exceed a desired power curve of the pump.

3. A method, as set forth in claim 2, wherein the desired power curve of the pump is a function of a pump discharge flow rate and a pump discharge pressure.

4. A method, as set forth in claim 3, wherein determining a desired swashplate angle includes the step of maintaining operation of the pump at the desired power curve of the pump.

5. A method, as set forth in claim 3, wherein determining a desired swashplate angle includes the step of maintaining operation of the pump at a value less than the desired power curve of the pump.

6. A method, as set forth in claim 1, wherein determining an actual swashplate angle includes the step of sensing an actual swashplate angle.

7. A method, as set forth in claim 1, wherein determining a value of discharge pressure of the pump includes the step of sensing a value of discharge pressure of the pump.

8. A method, as set forth in claim 1, further including the step of determining a value of control pressure of hydraulic fluid from the servo valve to a control servo, the control servo being adapted to control the actual swashplate angle.

9. A method, as set forth in claim 8, wherein moving a servo valve spool in a servo valve to a desired position includes the step of moving the servo valve spool in the servo valve to the desired position as a function of the desired swashplate angle, the actual swashplate angle, the discharge pressure, and the control pressure.

10. A method, as set forth in claim 9, wherein determining a value of control pressure includes the step of sensing a value of control pressure.

11. A method for controlling a variable displacement hydraulic pump having a swashplate pivotally attached to the pump, including the steps of:

determining a desired swashplate angle as a function of a power limit of the pump;

determining an actual swashplate angle;

determining a value of discharge pressure of the pump;

moving a servo valve spool in a servo valve to a desired position as a function of the desired swashplate angle, the actual swashplate angle, and the discharge pressure;

responsively moving the swashplate to the desired swashplate angle position;

determining a value of control pressure of hydraulic fluid from the servo valve to a control servo, the control servo being adapted to control the actual swashplate angle;

wherein moving a servo valve spool in a servo valve to a desired position includes the step of moving the servo valve spool in the servo valve to the desired position as a function of the desired swashplate angle, the actual swashplate angle, the discharge pressure, and the control pressure; and compensating the desired position of the servo valve spool as a function of an adaptive on-line learning term.

12. A method, as set forth in claim 11, wherein compensating the desired position of the servo valve spool as a function of an adaptive on-line learning term includes the step of changing the adaptive on-line learning term over a period of time in response to uncertainties in parameters associated with at least one of the pump and the servo valve.

13. A method for controlling a variable displacement hydraulic pump having a swashplate pivotally attached to the pump, including the steps of:

determining at least one previous desired swashplate angle;

determining a desired swashplate angle as a function of a power limit of the pump;

determining an actual swashplate angle;

determining a value of discharge pressure of the pump;

determining a value of control pressure of hydraulic fluid from a servo valve to a control servo, the control servo being adapted to control the actual swashplate angle;

moving a servo valve spool in the servo valve to a desired position as a function of the at least one previous desired swashplate angle, the desired swashplate angle, the actual swashplate angle, the discharge pressure, and the control pressure; and responsively moving the swashplate to the desired swashplate angle position.

14. A method, as set forth in claim 13, wherein determining a desired swashplate angle as a function of a power limit of the pump includes the step of determining a desired swashplate angle which responsively maintains operation of the pump within a set of parameters indicative of a pump operating envelope, the pump operating envelope being a function of a pump discharge flow rate and a pump discharge pressure.

15. A method for controlling a variable displacement hydraulic pump having a swashplate pivotally attached to the pump, including the steps of:

determining a desired swashplate angle as a function of a power limit of the pump;

determining an actual swashplate angle;

determining a value of discharge pressure of the pump;

determining a value of control pressure of hydraulic fluid from a servo valve to a control servo, the control servo being adapted to control the actual swashplate angle;

moving a servo valve spool in the servo valve to a desired position as a function of the desired swashplate angle, the actual swashplate angle, the discharge pressure, and the control pressure; and responsively moving the swashplate to the desired swashplate angle position; and compensating the desired position of the servo valve spool as a function of an adaptive on-line learning term, wherein the adaptive on-line learning term is changed over a period of time in response to uncertainties in parameters associated with at least one of the pump and the servo valve.

16. An apparatus for controlling a variable displacement hydraulic pump, comprising:

a swashplate pivotally attached to the pump;

a control servo operable to control an angle of the swashplate relative to the pump;

a servo valve having an output port hydraulically connected to the control servo and an input port hydraulically connected to a pump output port;

means for determining an actual swashplate angle;

means for determining a value of discharge pressure of the pump; and a controller electrically connected to the servo valve and adapted to determine at least one previous desired swashplate angle and a desired swashplate angle as a function of a power limit of the pump, and to move a servo valve spool in the servo valve to a desired position as a function of the at least one previous desired swashplate angle, the desired swashplate angle, the actual swashplate angle, and the discharge pressure.

17. An apparatus, as set forth in claim 16, wherein the controller is further adapted to determine a desired swashplate angle which responsively maintains operation of the pump at a value not to exceed a desired power curve of the pump.

18. An apparatus, as set forth in claim 17, wherein the desired power curve of the pump is a function of a pump discharge flow rate and a pump discharge pressure.

19. An apparatus, as set forth in claim 16, wherein the means for determining an actual swashplate angle includes a swashplate angle sensor.

20. An apparatus, as set forth in claim 16, wherein the means for determining a value of discharge pressure of the pump includes a pump discharge pressure sensor.

21. An apparatus, as set forth in claim 16, further including means for determining a value of control pressure of hydraulic fluid from the servo valve to the control servo.

22. An apparatus, as set forth in claim 21, wherein the means for determining a value of control pressure includes a control pressure sensor.

23. An apparatus, as set forth in claim 21, wherein the controller is further adapted to move the servo valve spool in the servo valve to the desired position as a function of the desired swashplate angle, the actual swashplate angle, the discharge pressure, and the control pressure.

24. An apparatus for controlling a variable displacement hydraulic pump, comprising:

a swashplate pivotally attached to the pump;

a control servo operable to control an angle of the swashplate relative to the pump;

a servo valve having an output port hydraulically connected to the control servo and an input port hydraulically connected to a pump output port;

means for determining an actual swashplate angle;

means for determining a value of discharge pressure of the pump;

a controller electrically connected to the servo valve and adapted to determine a desired swashplate angle as a function of a power limit of the pump, and to move a servo valve spool in the servo valve to a desired position as a function of the desired swashplate angle, the actual swashplate angle, and the discharge pressure; and wherein the controller is further adapted to compensate the desired position of the servo valve spool as a function of an adaptive on-line learning term.

25. An apparatus, as set forth in claim 24, wherein the adaptive on-line learning term is adapted to change over a period of time in response to uncertainties in parameters associated with at least one of the pump and the servo valve.

26. An apparatus for controlling a variable displacement hydraulic pump, comprising:

a swashplate pivotally attached to the pump;

a control servo operable to control an angle of the swashplate relative to the pump;

a servo valve having an output port hydraulically connected to the control servo and an input port hydraulically connected to a pump output port;

means for determining an actual swashplate angle;

means for determining a value of discharge pressure of the pump;

means for determining a value of control pressure of hydraulic fluid from the servo valve to the control servo; and a controller electrically connected to the servo valve and adapted to determine at least one previous desired swashplate angle and a desired swashplate angle as a function of a power limit of the pump, and to move a servo valve spool in the servo valve to a desired position as a function of the at least one previous desired swashplate angle, the desired swashplate angle, the actual swashplate angle, the discharge pressure, and the control pressure.

27. An apparatus, as set forth in claim 26, wherein the controller is further adapted to determine a desired swashplate angle which responsively maintains operation of the pump within a set of parameters indicative of a pump operating envelope, the pump operating envelope being a function of a pump discharge flow rate and a pump discharge pressure.

28. An apparatus for controlling a variable displacement hydraulic pump, comprising:

a swashplate pivotally attached to the pump;

a control servo operable to control an angle of the swashplate relative to the pump;

a servo valve having an output port hydraulically connected to the control servo and an input port hydraulically connected to a pump output port;

means for determining an actual swashplate angle;

means for determining a value of discharge pressure of the pump;

means for determining a value of control pressure of hydraulic fluid from the servo valve to the control servo;

a controller electrically connected to the servo valve and adapted to determine a desired swashplate angle as a function of a power limit of the pump, and to move a servo valve spool in the servo valve to a desired position as a function of the desired swashplate angle, the actual swashplate angle, the discharge pressure, and the control pressure; and wherein the controller is further adapted to compensate the desired position of the servo valve spool as a function of an adaptive on-line learning term, wherein the adaptive on-line learning term is changed over a period of time in response to uncertainties in parameters associated with at least one of the pump and the servo valve.

* * * * *